US008985125B2

(12) United States Patent
Schulz

(10) Patent No.: US 8,985,125 B2
(45) Date of Patent: Mar. 24, 2015

(54) PAINT ROLLER CLEANER

(76) Inventor: David A. Schulz, Boise, ID (US)

( * ) Notice: Subject to any disclaimer, the term of this patent is extended or adjusted under 35 U.S.C. 154(b) by 902 days.

(21) Appl. No.: 13/080,108

(22) Filed: Apr. 5, 2011

(65) Prior Publication Data

US 2012/0255587 A1 Oct. 11, 2012

(51) Int. Cl.
*B08B 3/04* (2006.01)
*B44D 3/00* (2006.01)

(52) U.S. Cl.
CPC .. *B44D 3/006* (2013.01); *B08B 3/04* (2013.01)
USPC ..... 134/137

(58) Field of Classification Search
CPC ..... B44D 3/006
USPC ..... 134/137
See application file for complete search history.

(56) References Cited

U.S. PATENT DOCUMENTS

| | | | | |
|---|---|---|---|---|
| 4,172,373 | A | 10/1979 | Lary | |
| 4,517,699 | A | 5/1985 | Petricka | |
| 5,060,895 | A * | 10/1991 | Stuart | 248/176.1 |
| 5,111,834 | A | 5/1992 | O'Brien | |
| 5,322,081 | A | 6/1994 | Isaac | |
| 5,332,014 | A * | 7/1994 | Feig | 141/110 |
| 5,932,028 | A | 8/1999 | Carrie et al. | |
| 6,012,473 | A * | 1/2000 | Koyama | 134/149 |
| 6,116,255 | A | 9/2000 | Walter | |
| 6,446,648 | B1 * | 9/2002 | King | 134/140 |
| 7,325,556 | B2 | 2/2008 | Walter | |
| 2003/0097183 | A1 * | 5/2003 | Rauscher et al. | 623/19.13 |

* cited by examiner

*Primary Examiner* — Michael Barr
*Assistant Examiner* — Spencer Bell
(74) *Attorney, Agent, or Firm* — Pedersen and Company, PLLC; Ken J. Pedersen; Barbara S. Pedersen

(57) ABSTRACT

A paint roller cleaner has a base for resting in a sink and a knob for receiving on its outside surface the inside surface of a paint-laden paint roller. The knob is adjustable relative to the base, and/or the roller is adjustable relative to the knob, so that the roller is vertical and water filing the roller will evenly and uniformly overflow and clean the roller outer surface. The knob may be an upstanding, tapered, hollow cylinder that rotates about a horizontal axis at its base to adjust its angle relative to the base, wherein the tapered cylindrical surface allows the cleaner to cooperate with variously-sized rollers. In another version, the knob is a hollow sphere, with its top end truncated, and with several spaced-apart vertical slits in its side, like a collet, for flexing/bending to various diameters to cooperate with variously-sized rollers. In another version, the knob is a sphere.

22 Claims, 12 Drawing Sheets

PAINT ROLLER CLEANER

BACKGROUND OF THE INVENTION

1. Field of the Invention

This invention relates generally to painting with paint rollers. More specifically, this invention relates to devices used to clean paint rollers, especially a stand for supporting a paint roller in a sink for flushing residual water-based paint from a paint roller.

2. Related Art

U.S. Pat. No. 4,172,373 (Lary) discloses a paint roller washer which is an upstanding tube which telescopingly receives the roller on the outside of the tube. A water supply nipple communicates from the outside to the bottom inside of the tube.

U.S. Pat. No. 4,517,699 (Petricka) discloses a paint roller washer which is an annular sleeve with scrubber elements on its inner surface for receiving the roller on the inside of the sleeve.

U.S. Pat. No. 5,111,834 (O'Brien) discloses a paint roller washer which is a stand with a cylindrical base for receiving the inside surface of the roller. The stand has an adjustable screw in its bottom which permits the vertical angle of the stand to be adjusted.

U.S. Pat. No. 5,322,081 (Isaac) discloses a paint roller washer which is a tube that connects at one end to a garden hose. On the other end of the tube for insertion into the roller is a perforated section which permits water to spray perpendicularly outward through the nap of the roller.

U.S. Pat. No. 5,932,028 (Carrie, et al.) discloses a paint roller washer which is an upstanding tube for receiving the paint roller while it is still attached to its handle. The top of the tube is provided with a wash water inlet, and the bottom has a stand with articulating legs.

U.S. Pat. No. 6,116,255 (Walter) and U.S. Pat. No. 7,325,556 (Walter) disclose containers for receiving a paint roller still attached to its handle, the containers also receiving a spray wand for washing a roller. The containers also have an exit port at the bottom for draining the paint-laden rinse liquid.

SUMMARY OF THE INVENTION

The present invention is a paint roller cleaner with a base for resting in a sink or other water receptacle preferably having a drain. On top of the base is a knob for receiving on its outside surface the inside surface of a paint-laden paint roller, wherein the knob is preferably substantially shorter in its height dimension compared to the length of the paint roller. In one preferred embodiment, the knob is a generally cylindrical member, with a decreasing diameter toward the top end of the member. The generally cylindrical knob is preferably an upstanding, tapered, hollow cylinder which rotates about a horizontal axis at its lower end to adjust its vertical angle. Also, the generally cylindrical knob may be called a hollow, truncated cone. In another embodiment, the knob is a hollow sphere, with its top end truncated, and with several spaced-apart vertical slits in its side, like a collet, so that the sphere with slits may be compressed by the paint roller. In yet another embodiment, the knob is a sphere. In each case, the knob preferably has a height (extending longitudinally up from the base) that is less than ½ of the length of the paint roller. More preferably, the knob has a height that is ⅓, and more preferably less than ¼, of the length of the paint roller.

In use, a paint-laden roller is removed from its handle, and pressed onto the top of the knob so that the roller is supported securely, generally vertically. Then, the roller and knob are adjusted relative to the base and/or relative to each other so that the paint roller is substantially exactly vertical, and most preferably within 5 degrees of exactly vertical, so that the paint roller circular top edge is perpendicular to the flow of water. This way, water overflowing the top end of the roller will tend to evenly overflow the circular top edge of the roller, and clean the roller, all the way around the circumference of the roller and all the way down the length of the external surface of the paint roller. In the preferred generally cylindrical knob embodiment, the knob member is pivotal, on a single horizontal axis, relative to the base for adjusting the paint roller to substantially vertical. This way, the angle of the movable cylinder, with the roller securely attached to the moveable cylinder, is adjusted relative to the stationary base. In the preferred collet-knob embodiment, the roller is adjusted relative to the base and knob that are stationary relative to each other. The collet-knob may flex and compress, depending on the diameter of the paint roller and depending on positioning of the paint roller relative to the collet-knob, in order to secure the roller firmly and in order to adjust the roller to substantially vertical. In the spherical-knob embodiment, the knob is stationary relative to the base, and the paint roller is adjustable to substantially-vertical due to the inner circumference of the roller being placeable in various positions on the sphere. The sphere may be non-compressible, with a diameter that is equal to or slightly larger than the internal diameter of the paint roller, so that the roller may be secured and sealed on the sphere and not be loose on the sphere. Or, the sphere may be slightly compressible, so a roller slightly smaller than the diameter of the sphere may be secured and sealed on the sphere by forcing the roller onto the sphere in the desired position.

In all of the preferred embodiments, the contact between the inside surface of the bottom of the roller and the outside surface of the knob provides a seal which lets the inside volume of the roller fill up with rinse liquid, for example, water from a faucet in a sink, which is delivered to the inside volume. This way, if the roller is at least somewhat porous, some of the rinse liquid may pass through the porous wall and nap of the roller to become paint-laden. Also, some of the rinse liquid overflows the top end of the roller and runs down the outside of the roller, becoming paint-laden and draining away into the sink.

Objects of the present invention include convenient and efficient cleaning of a paint roller by setting the paint roller upright in a sink and letting water from the faucet fill up the interior passageway of the paint roller, to flow over the top edge of the roller evenly all around the roller. The cleaner device provides cleaning with a minimum of water, as little or none will leak out the bottom of the roller and water flows evenly down the entire outer wall of the roller. By using the cleaner device, a user need not handle the roller to a great extent, and little or no water bypasses the roller or splashes onto the surrounding surfaces.

The preferred embodiments are easy to use and do not require significant mechanical skill or dexterity. The user may set the cleaner in the sink, with the base on the sink surface. The user then may grasp the roller and push it over the knob of the device, and adjust the roller to vertical by simply pivoting the roller while the base of the device is firmly pressed against the sink surface. The preferred cleaner does not include, and the user need not manipulate, more complex adjustments such as threaded adjustment screws. The user typically need not grasp both the base and the roller to adjust the paint roller to vertical, but rather may typically adjust the paint roller to vertical with one hand pressing down on and pivoting the paint roller.

The preferred embodiments are simple and economical in their structure, size, and the amount of materials used to make them. The preferred embodiments are short relative to the roller, and the cleaner device takes up little storage space. The preferred embodiments have no structure that extends along or contacts the outside surface of the paint roller. Preferably, the cleaner does not surround or envelope the outside surface of the paint roller, and does not spray water on the outside surface. The cleaner has no hose or hose connection. The cleaner base rests on its bottom surface, and/or portion(s) of the bottom surface that are lowermost surface(s) of the base, wherein said bottoms surface or lowermost surface(s) are preferably on a single plane.

While the painting device being installed on the cleaner of the present invention is described as a "paint roller" herein, it will be understood that the paint roller is a piece/assembly that is also often called a "paint roller cover". This paint roller cover is typically detached from a paint roller handle for cleaning, reattached to the handle, and re-used, as is known in the art.

DETAILED DESCRIPTION OF THE INVENTION

Figure 1:
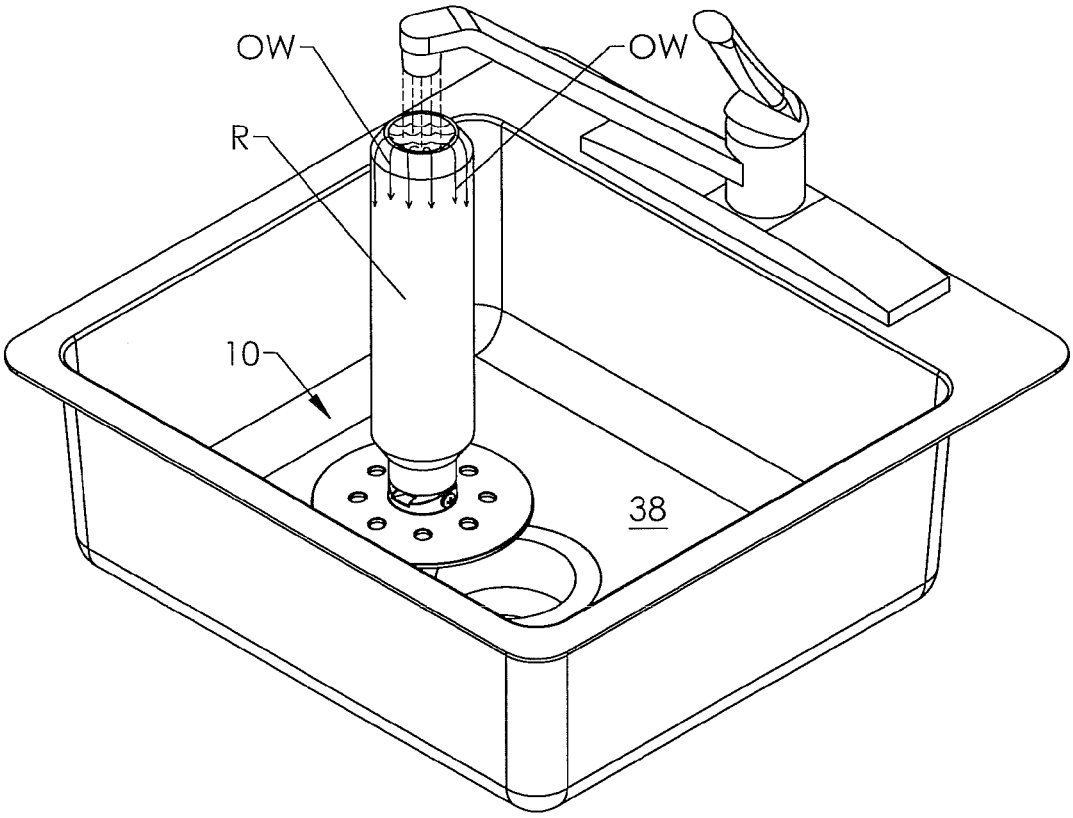
FIG. 1 is a top, perspective, schematic view of one embodiment of the present paint roller cleaner invention is use in a sink, with a paint roller installed on the cleaner.
Figure 2:
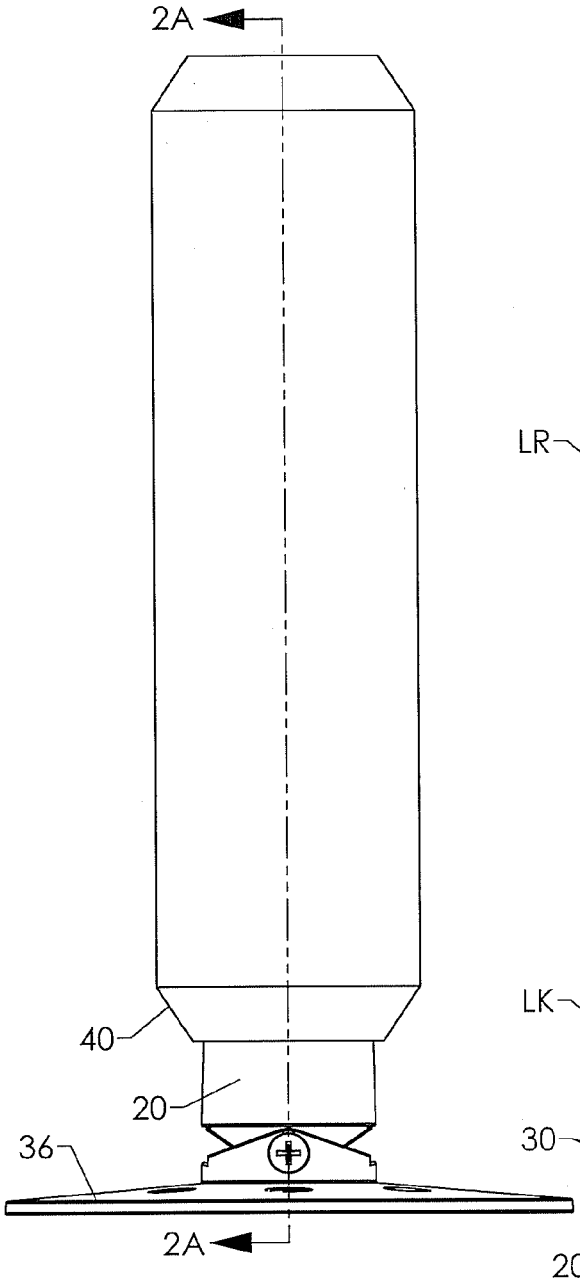
FIG. 2 is a side view of the embodiment of FIG. 1, removed from the sink, but still with the paint roller still installed thereon.
Figure 2A:
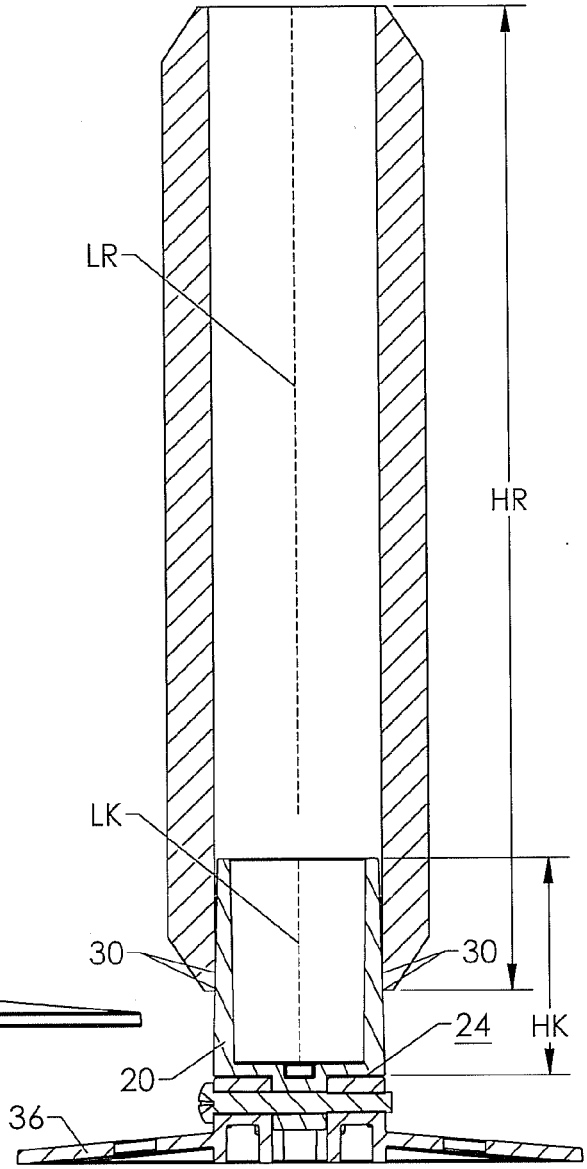
FIG. 2A is a cross-sectional view of the embodiment of FIGS. 1 and 2, including the paint roller installed on the cleaner.

Referring to the figures, there are shown several, but not the only, embodiments of the invented paint roller cleaner. In use, a paint-laden roller is removed from its handle, and pressed onto the top of the knob so that the roller is supported securely and generally vertically. Then, the roller or the knob is adjusted to be substantially or exactly vertical, by pressing the paint roller downward, which presses the base against the sink surface, and pivoting the roller, which pivots the knob-plus-roller relative to the base, or, in some embodiments, the roller relative to the knob. In a tapered-cylinder-knob cleaner, the angle of the movable cylinder, with the roller securely attached, is adjusted relative to the stationary base. In a collet-knob embodiment and a spherical-knob embodiment, the roller is adjusted relative to the stationary combined-base-and-knob assembly. Contact between the inside surface of the bottom of the roller and the outside surface of the knob provide a seal that lets the inside volume of the roller fill up with rinse liquid, for example, water from a faucet in a sink, which is delivered to the inside volume. The rinse liquid overflows the outside of the roller, so that paint-laden rinse liquid runs down the outside of the roller, and drains away into the sink. As most roller walls are not porous, or slightly porous at most, water will fill up the inside volume and overflow the top edge of the roller. If rollers are slightly porous, a small amount of water may also pass through the roller wall to additionally clean the roller wall and nap.

The cleaners "knob" protrusion receives and liquid-seals with paint rollers for cleaning. The term "knob" is used, as the protrusion is preferably of dimensions that are relatively short compared to the length of the roller, and is received in only a portion of the roller, that is, preferably the bottom couple of inches of the roller. The knobs may be generally cylindrical, but short compared to the roller, or may be semi-spherical or spherical, for example. Two of the embodiments are specifically adapted to receive and liquid-seal to multiple rollers having different internal diameters, by virtue of having multiple and/or tapered external diameters onto which rollers may slide and seal, or by virtue of having multiple slightly flexible portions separated by slits/slots, wherein the portions may be compressed together by the roller upon installation of the roller. Optionally, the slits/slots may substantially close or otherwise seal upon compression, to prevent significant water flow through the slit/slots near the roller wall and out the bottom end of the roller.

Another embodiment, a simpler spherical embodiment, is less-well adapted for rollers with different diameters. The simpler, not slotted, spherical-knob cleaner may be provided with different sphere sizes, each one being suited to fit a particular roller diameter. In the simpler, spherical-knob cleaners, there may be a small amount of leeway in what rollers the sphere will receive depending on the compressibility of the sphere material(s) and the stretch-ability of the roller material(s). Optionally, a sealing ring (not shown) or other compressible seal region, at or near the equator of the sphere, may be provided so that said ring/region will compress a fraction of an inch to account for the slightly-different diameters of conventional paint rollers.

Referring specifically to the Figures, FIGS. 1-11 portray one embodiment of cleaner 10 wherein the knob 20 of the cleaner is generally cylindrical, but slightly tapered-in-diameter, for receiving and liquid-sealing with multiple internal diameters of paint rollers R. Although many rollers are uniform or "standard", some have slightly different internal diameters, for example, internal diameters that are different by a fraction of a millimeter up to a few millimeters. Therefore, a slight taper is preferred, from a larger external diameter 22 at or near the bottom surface 24 of the generally cylindrical knob to a smaller external diameter 26 at or near the top edge 28 of the knob 20. The preferred difference between the larger and the small diameter is preferably 0.1 inches (2.54 mm) over a cylinder length of approximately 1.5-2 inches. This allows for the slight variances in conventional paint roller internal diameters. A wider range of diameters may be provided on the knob, for example, a range of diameter difference of 0.1-0.2 inches (2.54-5.08 mm) over 1.5-2 inches of knob length. If other paint rollers are brought to market that have other internal diameters, the knob may be sized to accommodate such alternative rollers.

The height HK of the knob 20, measured along the longitudinal axis LK of the knob from the bottom surface 24 to the top edge 28 is preferably about 1-4 inches, and more preferably 2-3 inches, compared to rollers that typically are about 9 inches long along the longitudinal axis LR. Therefore, it is preferred to have the knob longitudinal axis LK be less than ½ of the length of the roller, and more preferably less than ⅓ or ¼ of the length of the roller. This way, water from a faucet, for example as in FIG. 1, will flow into the central space of the roller and contact nearly the entire interior surface of the roller as it fills up the interior, and overflows the outside, of the roller. Also, if any roller wall has any porosity, some water may flow/seep through the wall of the roller nearly all along the roller, to exit, paint-laden, through the exterior nap of the roller. The knob contacts, and liquid-seals to, the interior surface only along a region represented by a small length 30 of a generally cylindrical knob or at the "equator" region 32, 34 of a semi-spherical or spherical knob, for example, contact along preferably less than 20 percent, or more preferably along less than 10 percent of the interior surface of the roller. Also, the region of contact between the knob and the roller is typically very near the bottom 40 of the roller, so that the mounting of the roller to the cleaner may be said to be the bottom end of the roller being mounted and sealed to the cleaner. Thus, the knob blocks very little of the water from the interior surface of the roller.

FIG. 1 shows cleaner 10 in use in a sink, with the bottom end of the roller installed on the knob 20 of the cleaner 10, and with the knob 20 adjusted relative to its base 36 so that the roller is substantially or exactly vertical. Such adjustment may be necessary, depending on the curvature/slope of the sink basin surface 38, and the location at which the base 36 is placed against the surface 38. Many modern sinks have a surface 38 that slopes about 10-20 degrees from horizontal, but other sinks may have a surface that slopes more or less. Therefore, the angle of the base 36 to horizontal when placed in various sinks may vary, and adjustment of the knob relative to the base (or the roller to the knob, in other embodiments) is necessary. If the base is non-exactly horizontal because of the curvature/slope of the surface 38, the base may be placed in position while the knob 20 is tilted relative to the base to make the roller consequently substantially or exactly vertical, which typically translates to the top edge of the cylindrical knob being substantially or exactly horizontal. This way, water OW overflowing the roller will tend to overflow evenly, and clean evenly, around the entire circumference of the roller, rather than running over on one side or another.

Figure 3:
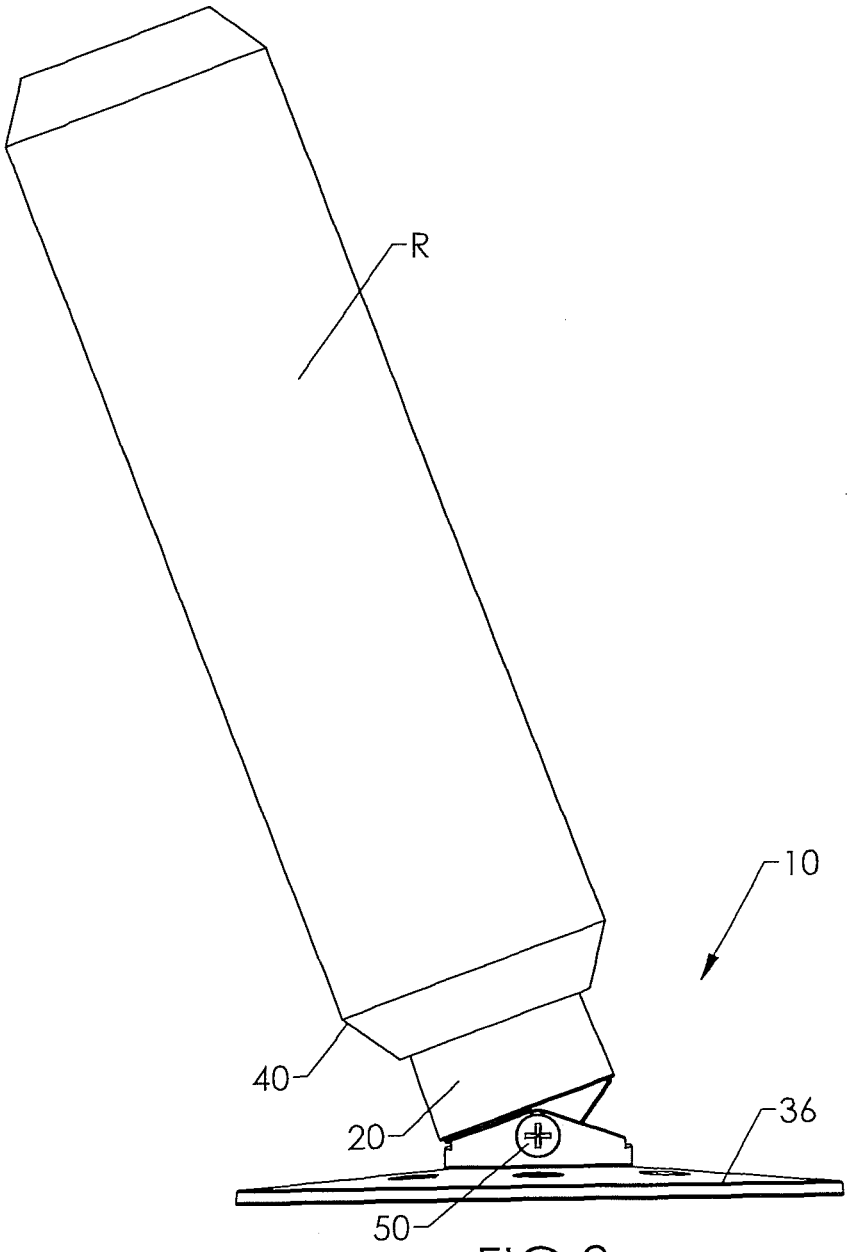
FIG. 3 is a side view of the embodiment of FIGS. 1 and 2, with the generally cylindrical knob member tilted relative to the base, to adjust the angle of the longitudinal axis of the paint roller to the bottom plane of the base.
Figure 4:
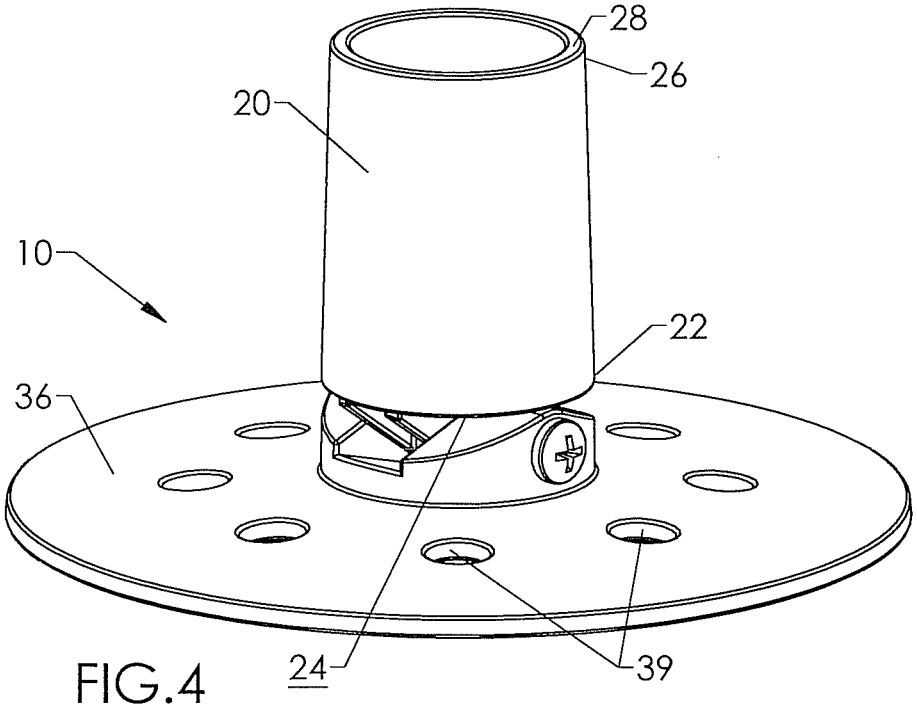
FIG. 4 is a side perspective view of the cleaner embodiment of FIGS. 1-3, with paint roller removed.
Figure 5:
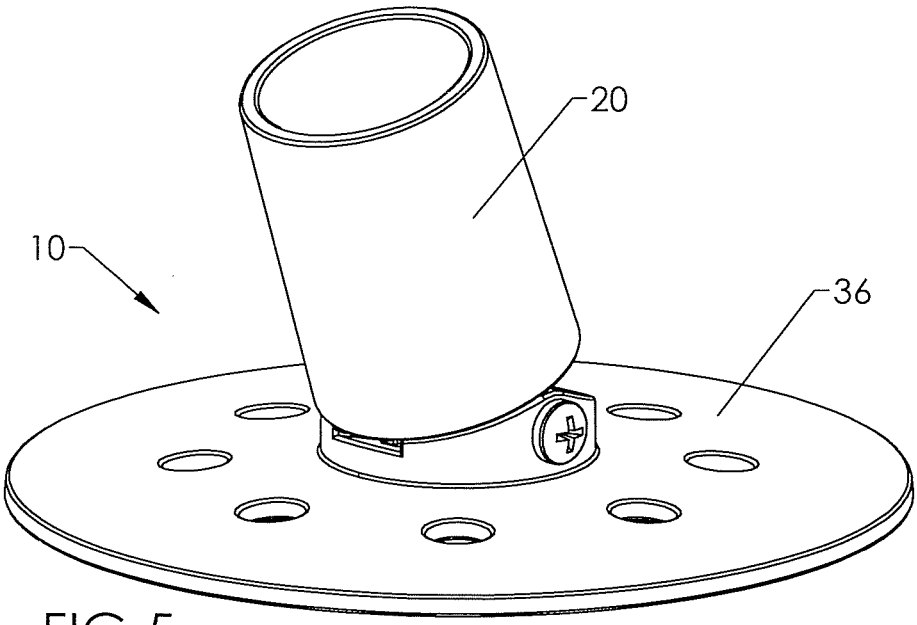
FIG. 5 is a side perspective view of the cleaner of FIGS. 1-4, with the generally cylindrical knob tilted relative to the base, for example, as it is in FIG. 3.
Figure 6:
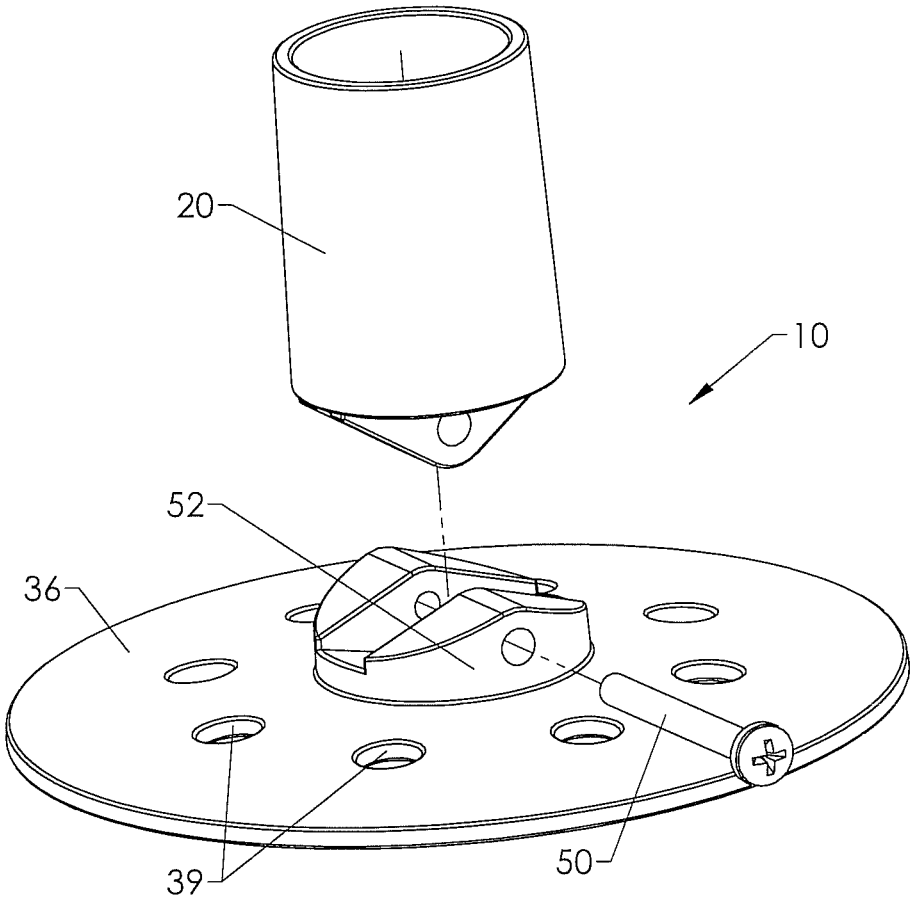
FIG. 6 is an exploded view of the cleaner embodiment of FIGS. 1-5.
Figure 7:
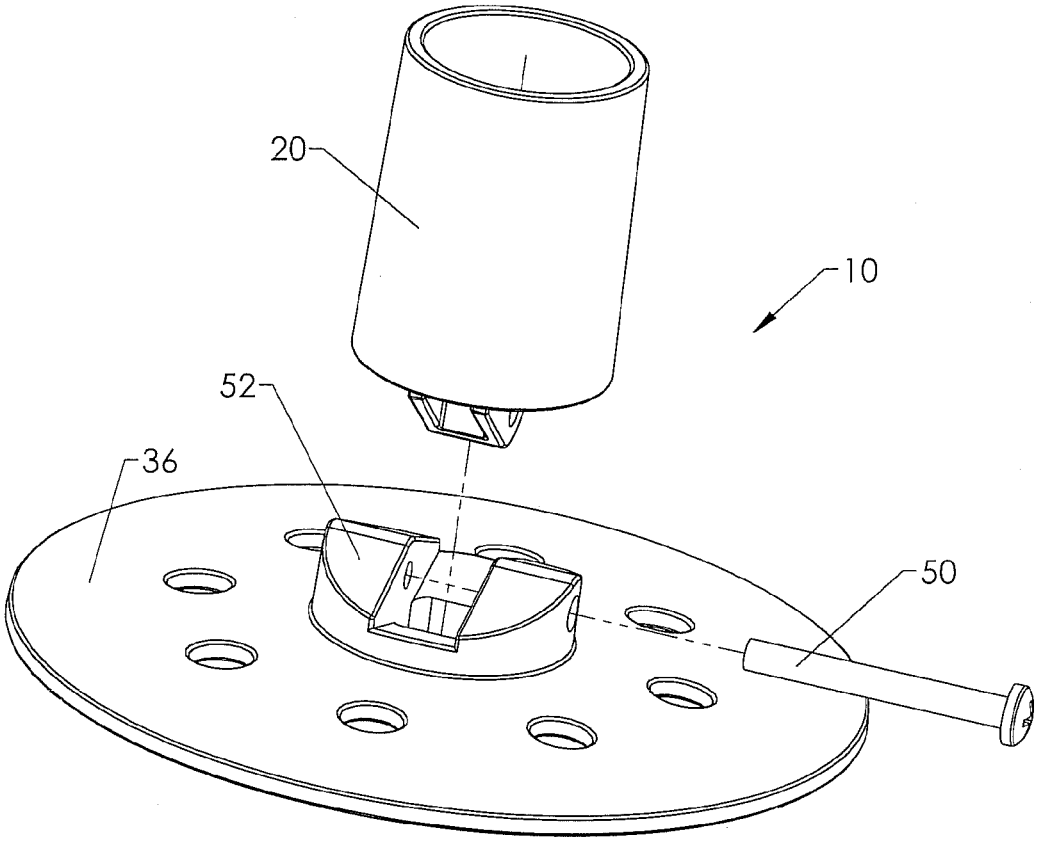
FIG. 7 is another exploded view of the cleaner embodiment of FIGS. 1-6, viewed from a different angle compared to the view in FIG. 6.
Figure 8:
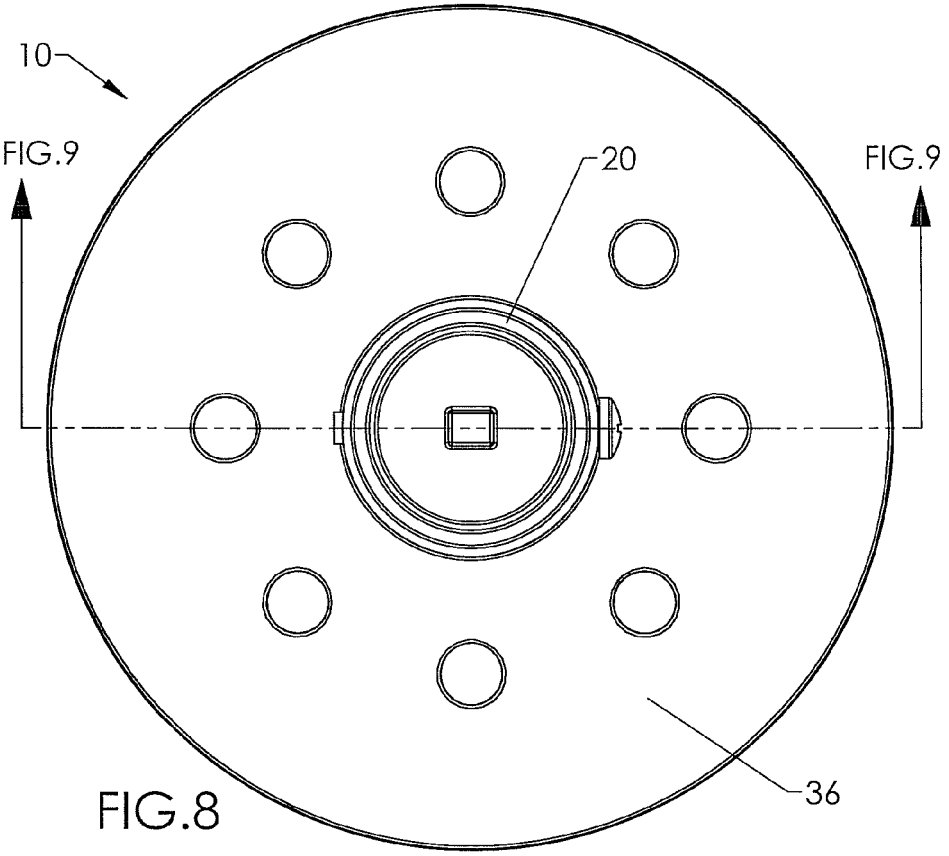
FIG. 8 is a top view of the cleaner of FIGS. 1-7.
Figure 9:
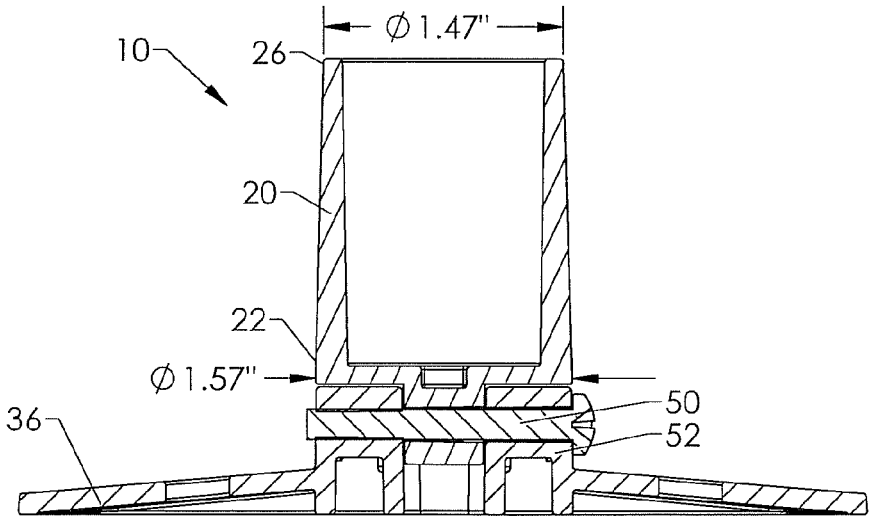
FIG. 9 is a side cross-sectional view of the cleaner of FIGS. 1-8, viewed along the line 9-9 in FIG. 8.
Figure 10:
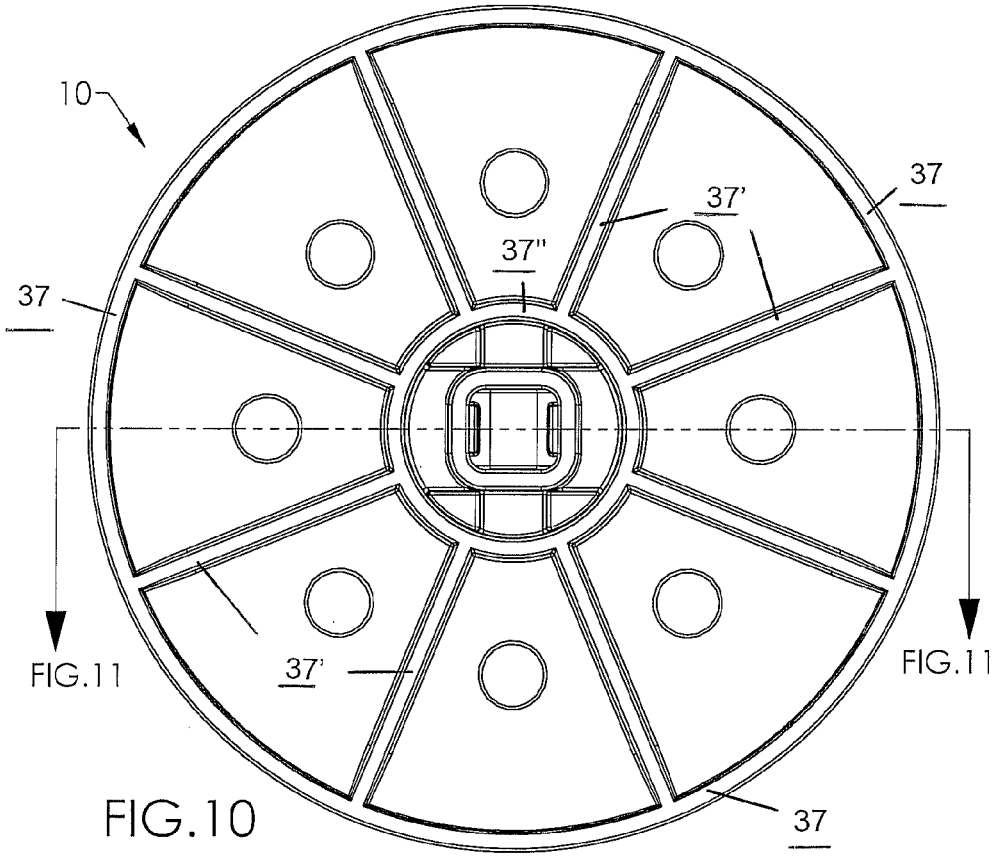
FIG. 10 is a bottom view of the cleaner of FIGS. 1-9.
Figure 11:
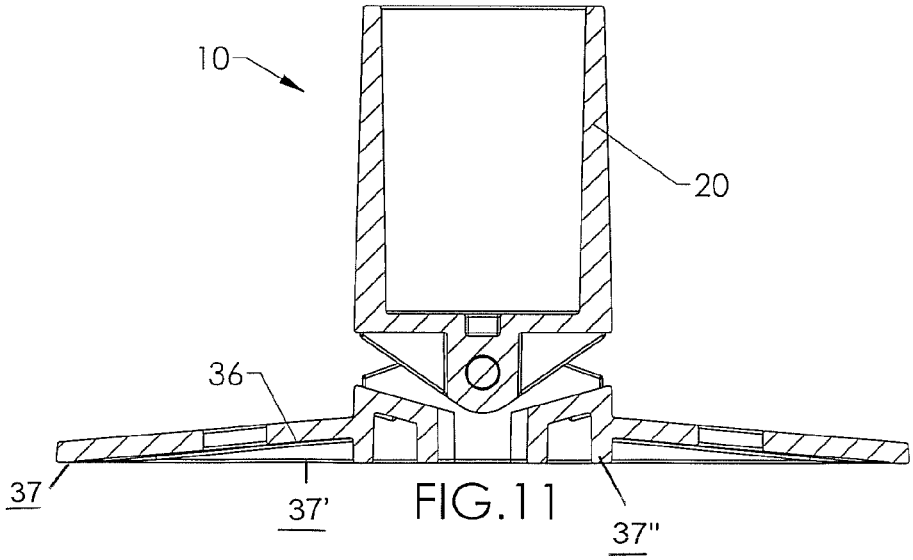
FIG. 11 is a side cross-sectional view of the cleaner of FIGS. 1-10, viewed along the line 11-11 in FIG. 10.
Figure 12:
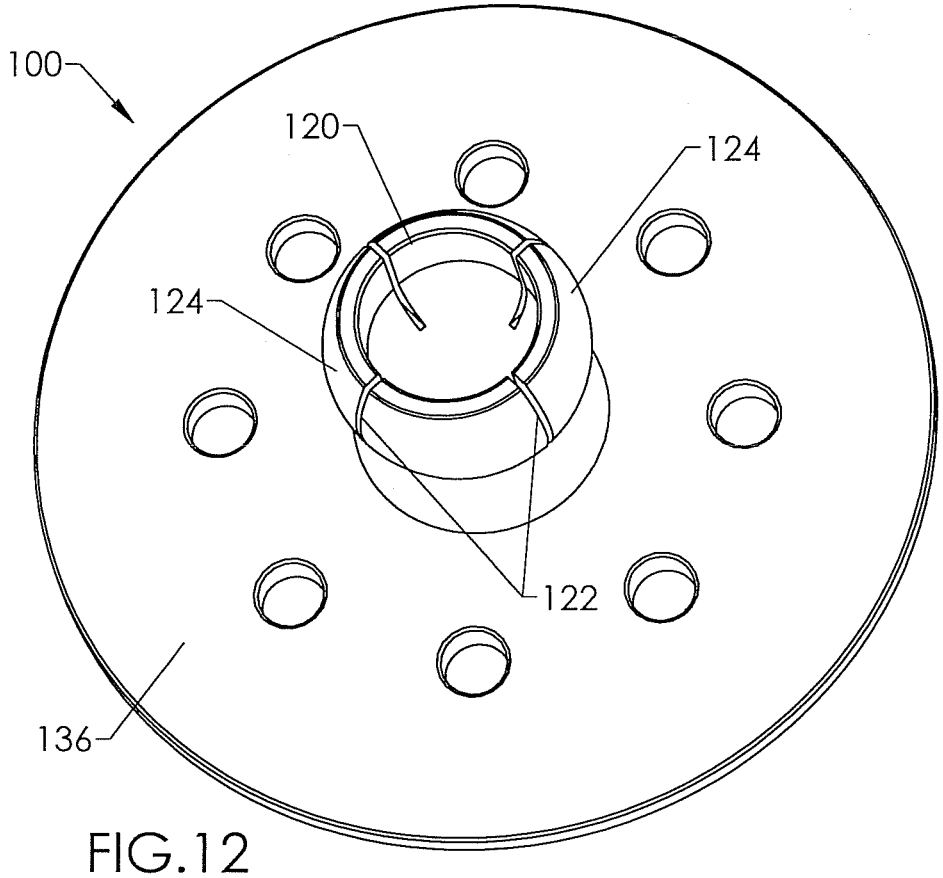
FIG. 12 is a top perspective view of an alternative embodiment of a paint roller cleaner, shown without any paint roller installed, wherein the collet-style knob of the cleaner is a hollow, generally spherical knob with the top of the sphere removed and with slits through the wall of the hollow sphere.
Figure 13:
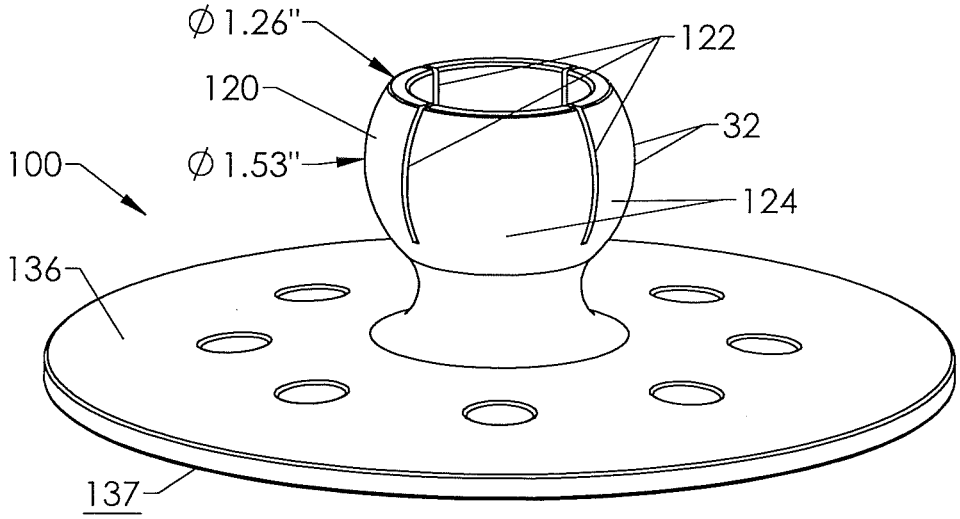
FIG. 13 is a side perspective view of the cleaner of FIG. 12.
Figure 14:
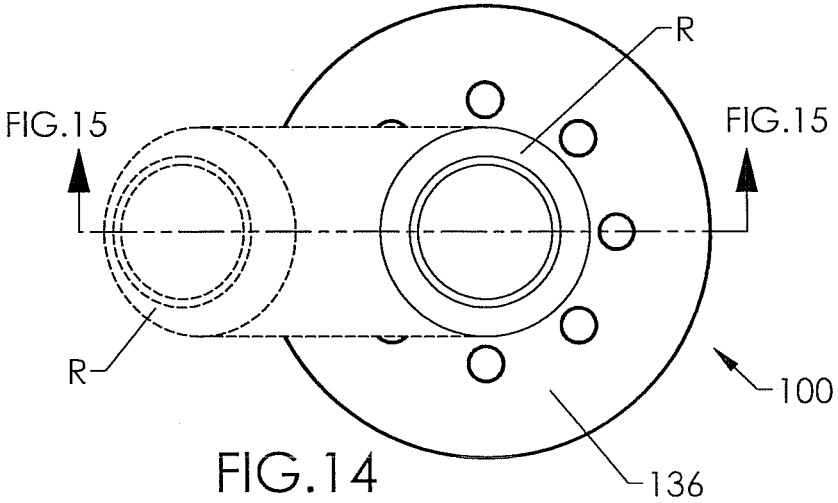
FIG. 14 is a top view of the cleaner of FIGS. 12 and 13, with a paint roller installed, wherein the paint roller is shown in solid lines in a position perpendicular to the bottom surface of the base, and in dashed lines when tilted on the collet-knob to an acute angle relative to the bottom surface of the base.

Details of the cleaner 10 are shown in FIGS. 2, 2A, and 3-11. The knob 20 is pivotally connected to the base 36 by a pivoting axle pin 50 that pivotally connects a lower portion of the knob 20 with an upwardly protruding portion 52 of the base. The knob 20 may pivot to the left and right in FIGS. 2 and 3. If this does not make the knob and roller substantially or exactly vertical, then the cleaner may be rotated and/or otherwise moved in position, so that said rotation and/or movement combined with pivoting of the knob-base connection, serves to make said knob and roller substantially or exactly vertical. Note that FIGS. 3 and 5 illustrate the base being horizontal and the knob tilted to be non-vertical. In actual use, said tilting of the knob relative to the base would be done, but the base would rest non-horizontally on a curved/sloped sink surface and the knob and roller would be vertical. The base 36 preferably has apertures 39 through it, so that water may flow through it, if necessary, to reach the drain, especially if the base is positioned directly over the drain. The base lowermost portion(s) or surface(s) are preferably flat and not adjustable or movable portions of the base. For example, as shown in FIGS. 10 and 11, the base 36 has flat, lowermost surfaces 37, 37', and 37" upon which the base rests in the sink. There are preferably no legs, screws, pivot members or other protrusions extending down past said lowermost surfaces 37, 37', and 37". There may be recesses between said surfaces 37, 37', and 37", for example, for molding or plastic-saving considerations, but there are not screws or legs protruding downward from the base.

FIGS. 12-15 illustrate a partial or semi-spherical knob cleaner embodiment 100, the knob 120 which is a generally or exactly spherical shape with a top portion removed (truncated). The knob 120 is fixed to the base 136, so that it is not pivotal or adjustable relative to the base 136 and not pivotal or adjustable relative to the bottom surface 137 of the base. Slits 122 extend through the wall of the hollow sphere at several places around the sphere, to allow the multiple portions 124 to flex slightly inward toward a central longitudinal axis of the sphere to effectively reduce the diameter of the sphere, at least in the region which will contact and seal with the roller. The sphere is preferably 1.53 inches in diameter when not compressed and may compress easily to a diameter of 1.47 inches, for example, when compressed by a roller. This way, the knob 120 will accommodate rollers of different interior diameters, because said rollers are slid onto and downward on the knob, preferably to the equator of the sphere, which may force the portions 124 inward enough to allow secure and sealing engagement of the roller with the knob surface. The knob 120 may be adapted for a wider range of diameters, for example, a diameter of 1.57 inches that is easily compressible to 1.47 inches. If other paint rollers are brought to market that have other internal diameters, the knob may be sized to accommodate such alternative rollers.

Preferably, the slits 122 close or substantially close upon installation of the pain roller, in order to seal or substantially seal the slits from allowing water through the slits to and through the bottom end of the paint roller. Also, the knob 120 has a closed bottom. This way, even if some water flows through the slits 122 at the outside of the knob, the water will be a minimal volume compared to volume of water overflowing the roller and/or seeping through the roller.

Figure 15:
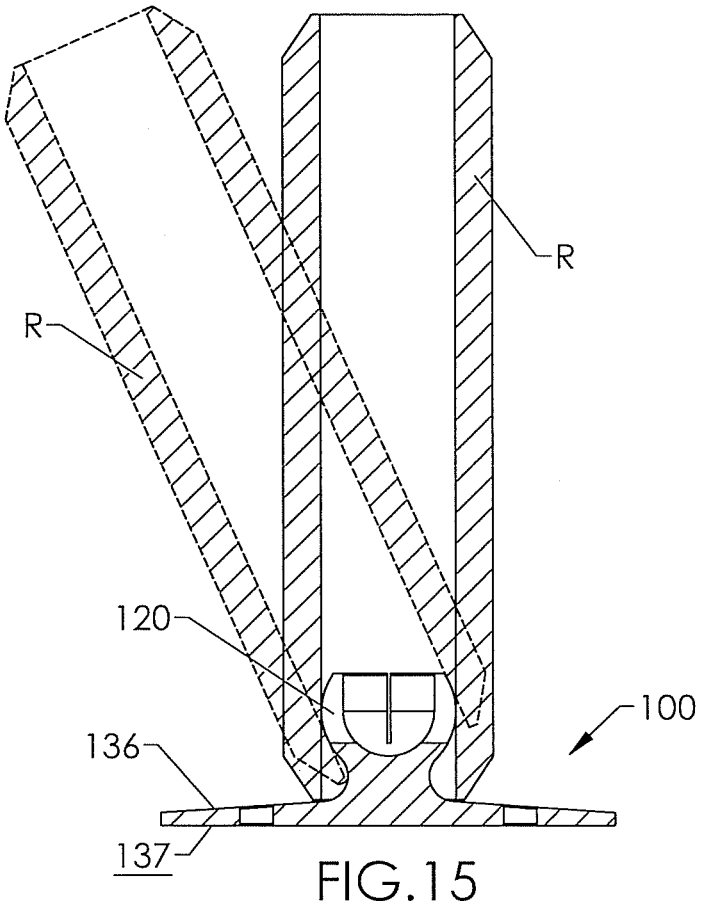
FIG. 15 is a side cross-sectional view of the cleaner of FIGS. 12-14, viewed along the line 1-15 in FIG. 14, so that the solid lines show the roller when perpendicular to the bottom surface of the base, and the dashed lines show he roller tilted relative to the stationary knob to reside at an acute angle to the bottom surface of the base.
Figure 16:
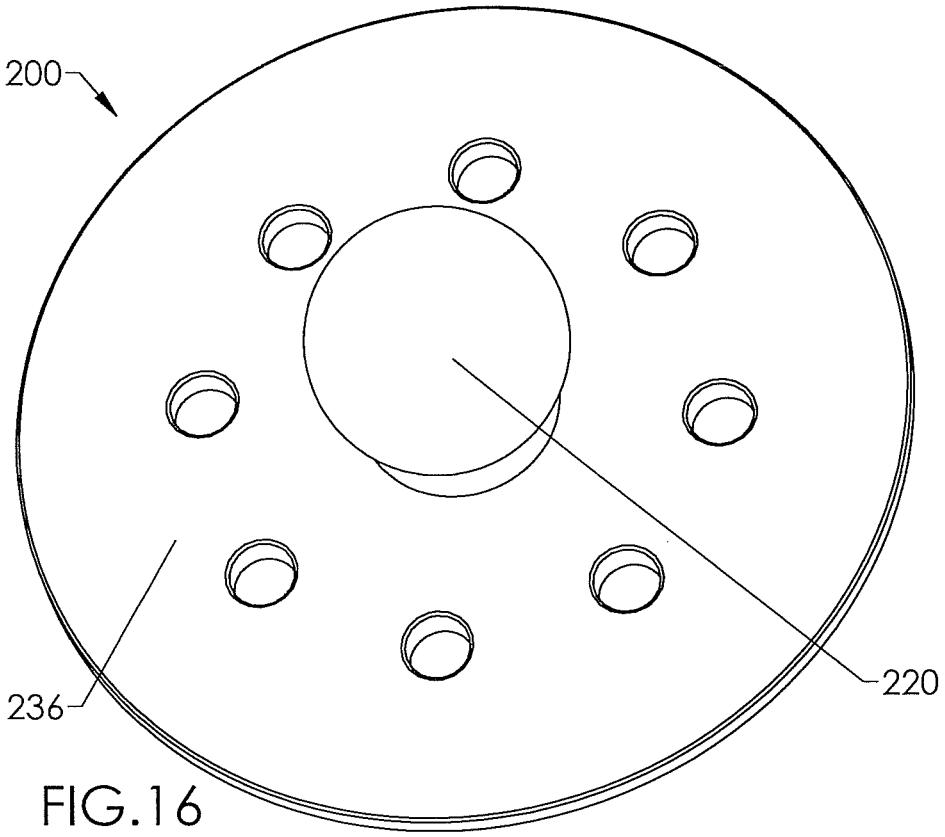
FIG. 16 is a top perspective of yet another embodiment of paint roller cleaner, wherein the knob is a sphere.
Figure 17:
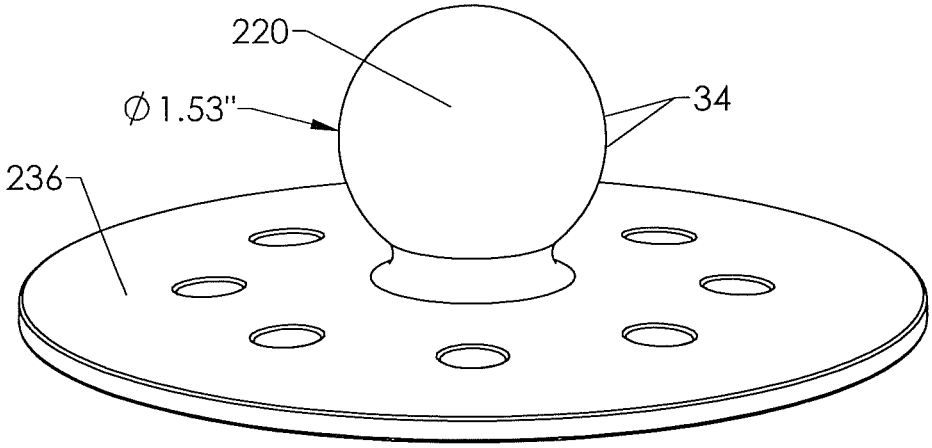
FIG. 17 is a side perspective view of the cleaner of FIG. 16.
Figure 18:
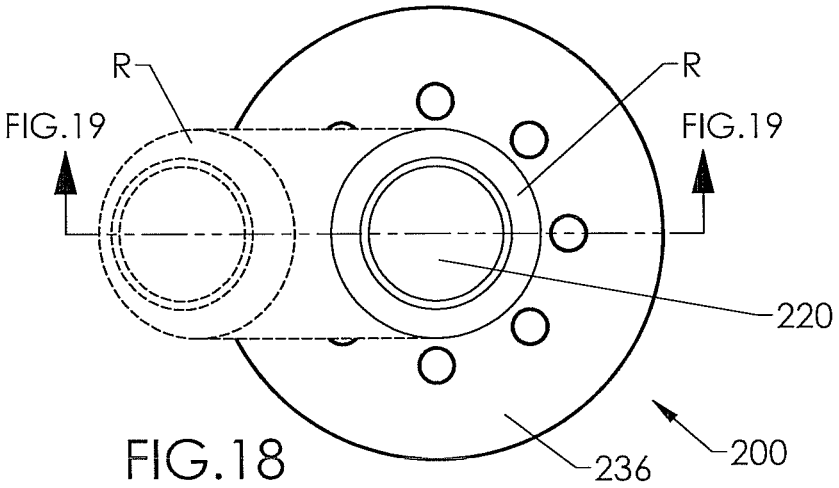
FIG. 18 is a top view of the cleaner of FIGS. 16 and 17, with a paint roller installed on the knob, showing example upright (solid lines) and tilted (dashed) positions of the paint roller, relative to the bottom surface of the base.

FIG. 15 illustrates how the roller may be pivoted/adjusted relative to the knob 120, to adjust the angle between the roller and the knob. This way, the bottom surface 137 of the base 136 may be placed on an uneven, slanted, curved, contoured or other non-horizontal surface, but the roller may be tilted on the partially-spherical knob 120 to an angle relative to the bottom surface that will place the roller longitudinal axis substantially or exactly vertical in the sink. As in other of the drawings described herein, the base 136 in FIG. 15 is shown horizontal and the roller is shown non-vertical, whereas, in actual use, the base will be non-horizontal and the roller will be vertical.

FIGS. 16-19 illustrate a cleaner embodiment 200 that has a spherical knob 220 that is not adjustable in diameter, except in embodiments wherein the knob 220 is compressible or has a sealing ring (not shown) or other compressible seal region, at or near the equator of the sphere, as mentioned above. The knob 220 and base 236 of cleaner 210 are shown in the drawings to be integrally formed as a single unit, so that the sphere is not movable relative to the base. The sphere will preferably either being solid, or hollow and without openings in the sphere wall. The sphere is preferably 1.53 inches in diameter when not compressed, as that is a typical diameter for most paint rollers. The knob 220 may be sized for different diameters, for example, multiple cleaners may be provided, each with a knob sized appropriately for each size of roller. Alternatively, spheres of different diameters may be provided for a single base, for example, by a threaded or other non-integral connection (not shown) of the knob to the base. Or, if the spherical knob is slightly resilient/compressible, at least in the equator region, and/or if the roller bottom end is slightly stretchable, then one size of sphere may receive and seal to multiple rollers with similar but not identical inner diameters. For example, the knob may have a diameter of 1.57 inches that is compressible to 1.47 inches, for example. If other paint rollers are brought to market that have other internal diameters, the knob may be sized to accommodate such alternative rollers.

Figure 19:
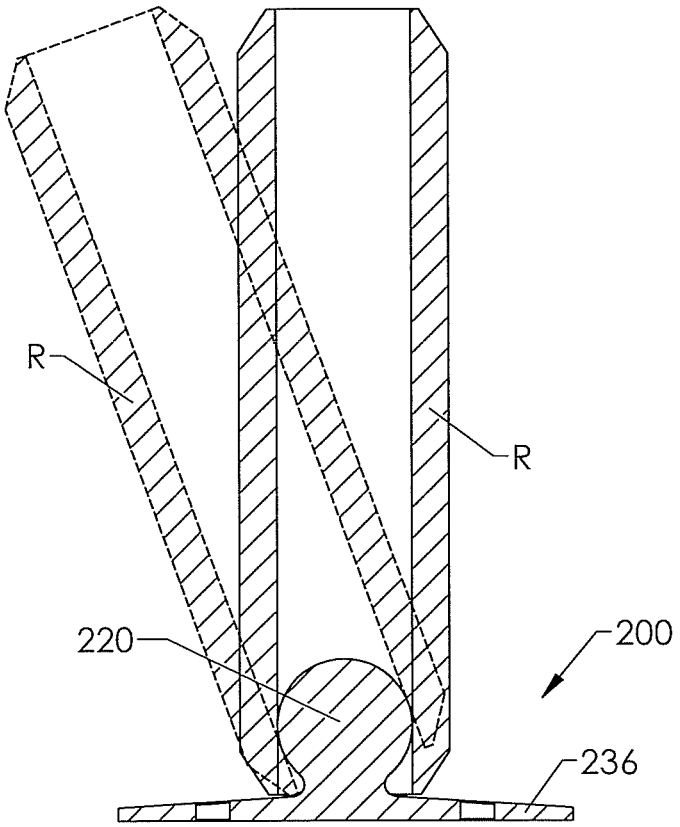
FIG. 19 is a side-cross-sectional view of the cleaner and paint roller of FIG. 18, again showing side views of the roller in an upright position and tilted position relative to the bottom surface of the base, viewed along the line 19-19 in FIG. 18.

FIG. 19 illustrates the adjustment of the roller on the spherical knob 220 by simply tilting the roller relative to the knob, wherein the roller interior surface may slide along the outer surface of the sphere for this adjustment. As in other of the drawings described herein, the base 236 in FIG. 19 is shown horizontal and the roller is shown non-vertical, whereas, in actual use, the base will be non-horizontal and the roller will be vertical.

The materials, of which the various cleaners are made, may be of various types and compositions. For example, molded plastics, metal, or other materials that are water-resistant or water-repellent may be used. The base is preferably rigid, to allow accurate one-handed adjustment of the roller to vertical, while the base is being pressed against the sink surface by the same hand pivoting the roller, as discussed above. The knob may be rigid, or may be slightly flexible and resilient, so that the roller fits on the knob in a sealing manner with preferably slight leeway in the fit of the roller to the knob by virtue of inward flexing (for example, see knob 120) and/or slight compression (for example, knob 220).

In some embodiments, the paint roller cleaning system may comprise: a base comprising a bottom surface, at least a portion of which is flat and on a plane; a knob pivotally connected to the base and comprising a generally cylindrical outer surface having a lower diameter at or near a lower end of the outer surface near the base, and an upper diameter at or near an upper end of the outer surface, said upper diameter being smaller than said lower diameter; and a paint roller having a longitudinal axis and an internal passageway, wherein a lower end of the passageway receives said knob so that the paint roller is held generally upright, and wherein the lower end of the passageway has an internal diameter that liquid-seals with the outer surface of the knob at a location between the upper end and the lower end of the knob having a diameter equal to the paint roller internal diameter; wherein, when the base is set on a sink surface so that said plane of said portion of the bottom surface is not horizontal, the roller and knob are pivotal relative to the base to an acute angle relative to said plane, so that the longitudinal axis of the roller is vertical and water filling the roller will overflow evenly around a top edge of said roller to clean the entire roller outer surface. In preferred embodiments, the base has no protrusions extending downward from said plane, specifically, the base preferably has no threaded legs and no pivotal legs protruding down from said plane. The knob is effective in adjusting the verticality of the paint roller even though it preferably pivots relative to the base on a single pivot axle. Typically, the knob outer surface will be rigid and non-compressible, however, in some embodiments, the knob outer surface may be compressible and/or otherwise formed and composed to encourage liquid-sealing.

A paint roller cleaner may be described as comprising: a base comprising a bottom surface, at least a portion of which is flat and on a plane; a knob pivotally connected to the base and comprising a conical outer surface slanting from a lower diameter at a lower end of the outer surface near the base, to an upper diameter at an upper end of the outer surface, wherein said upper diameter is smaller than said lower diameter and said knob is sized to be inserted into, and seal with, a paint roller internal passageway at a location between the upper end and the lower end of the knob having a diameter equal to an internal diameter of the internal passageway; wherein, when the base is set on a sink surface so that said plane of said portion of the bottom surface is not horizontal, the knob is pivotal relative to the base to an acute angle relative to said plane, so that the paint roller is held with the longitudinal axis of the roller vertical and so that water filling the roller will overflow evenly around a top edge of said roller to clean the entire roller outer surface.

Other embodiments may be described as being a paint roller cleaner comprising: a base comprising a bottom surface, at least a portion of which is flat and on a plane; a knob upending from the base and comprising a spherical outer surface having a spherical diameter, wherein said spherical diameter is sized to be inserted into, and seal with, a paint roller internal passageway; and wherein, when the base is set on a sink surface so that said plane of said portion of the bottom surface is not horizontal, the paint roller is pivotal on the spherical knob to be at an acute angle relative to said plane, so that the paint roller is held by the knob with the longitudinal axis of the roller vertical and so that water filling the roller will overflow evenly around a top edge of said roller to clean the entire roller outer surface. The knob may be hollow and defined by a sphere wall, wherein the sphere wall may have a truncated top edge and slits through the sphere wall that separate wall portions that flex inward to reduce the spherical diameter. Said slits may be spaced apart all around the circumference of the sphere and extend from said truncated top edge toward a bottom of the sphere that is connected to the base. Preferably, the slits extend down past an equator of the sphere, so that the flexible portions flex inward to reduce the equator diameter of the sphere, but preferably the slits to not extend all the way to the bottom of the sphere. Optionally, the sphere may be made of material(s) selected so that the sphere is compressible in a circumferential region at or near said equator. Alternatively, the knob may be rigid and non-compressible. In most embodiments having spherical knobs, the base is fixed to the base and is not pivotal relative to the base.

The invention may also include methods for using a cleaner as described herein. The methods are particularly beneficial as they are simple for a person to perform, even one who is not dexterous and/or wishes or must use only one hand.

Although this invention has been described above with reference to particular means, materials and embodiments, it is to be understood that the invention is not limited to these disclosed particulars, but extends instead to all equivalents within the broad scope of the following claims.

The invention claimed is:

1. A paint roller cleaning system comprising:

a base comprising a bottom surface, at least a portion of which is flat and on a plane for resting on a sink surface:

a knob comprising a longitudinal axis, a generally cylindrical outer surface having a lower diameter at or near a lower end of the outer surface near the base, and an upper diameter at or near an upper end of the outer surface, said upper diameter being smaller than said lower diameter, wherein the knob is pivotally connected to the base on a pivot axis that is perpendicular to said longitudinal axis of the knob; and a paint roller having a longitudinal axis, an internal passageway having an internal diameter, and a cylindrical roller outer surface, wherein a lower end of the passageway receives said knob so that the paint roller longitudinal axis is parallel to the knob longitudinal axis, and the paint roller is held generally upright, and wherein the lower end of the internal passageway has an internal diameter that liquid-seals with the outer surface of the knob at a location between the upper end and the lower end of the knob having a diameter equal to the paint roller internal diameter; and wherein the roller and knob are pivotal relative to the base on said pivot axis to an acute angle relative to said plane to place the longitudinal axes of the knob and of the paint roller vertical when said portion of the base is set on a non-horizontal portion of the sink surface, so that water filling the roller will overflow evenly around a top edge of said roller to clean the entire roller outer surface.

2. A paint roller cleaning system as in claim 1, wherein said base has no protrusions extending downward from said plane.

3. A paint roller cleaning system as in claim 1, wherein said base has no threaded legs and no pivotal legs protruding down from said plane.

4. A paint roller cleaning system as in claim 1, wherein said knob extends up into the passageway of the paint roller a distance equal to less than ½ of the length of the longitudinal axis of the paint roller.

5. A paint roller cleaning system as in claim 1, wherein said knob extends up into the passageway of the paint roller a distance equal to less than ⅓of the length of the longitudinal axis of the paint roller.

6. A paint roller cleaning system as in claim 1, wherein the pivot axis is horizontal.

7. A paint roller cleaning system as in claim 1, wherein the knob outer surface is rigid and non-compressible.

8. A paint roller cleaning system as in claim 1, wherein the knob outer surface is compressible.

9. A paint roller cleaner comprising:

a base comprising a bottom surface, at least a portion of which is flat and on a plane for resting on a sink surface;

a knob comprising a longitudinal axis, and a conical outer surface slanting from a lower diameter at a lower end of the outer surface near the base, to an upper diameter at an upper end of the outer surface, wherein said upper diameter is smaller than said lower diameter and said knob is sized to he inserted into, and seal with, a paint roller internal passageway at a location between the upper end and the lower end of the knob having a diameter equal to an internal diameter of the internal passageway, wherein the knob is pivotally connected to the base on a pivot axis that is parallel to said plane of said portion of the bottom surface of the base; and wherein the knob is pivotal on said pivot axis relative to the base to an acute angle relative to said plane to place the longitudinal axis of the knob vertical when said portion of the base is set on a non-horizontal portion of the sink surface, so that water filling the roller will overflow evenly around a top edge of said roller to clean the entire roller outer surface.

10. A paint roller cleaner as in claim 9, wherein said base has no protrusions extending downward from said plane.

11. A paint roller cleaner as in claim 9, wherein said base has no threaded legs and no pivotal legs protruding down from said plane.

12. A paint roller cleaner as in claim 9, wherein said knob has a longitudinal axis with a height that is sized to extend up into the passageway of the paint roller a distance equal to less than ½ of the length of the longitudinal axis of the paint roller.

13. A paint roller cleaner as in claim 9, wherein said knob has a longitudinal axis with a height that is sized to extend up into the passageway of the paint roller a distance equal to less than ⅓ of the length of the longitudinal axis of the paint roller.

14. A paint roller cleaner as in claim 9, wherein the pivot axis is horizontal.

15. A paint roller cleaner device consisting essentially of:

a base comprising a bottom surface, at least a portion of which is flat and on a plane for resting on a sink surface;

a knob comprising a longitudinal axis, and a conical outer surface slanting from a lower diameter at a lower end of the outer surface near the base, to an upper diameter at an upper end of the outer surface, wherein said upper diameter is smaller than said lower diameter and said knob is sized to be inserted into, and seal with, a paint roller internal passageway at a location between the upper end and the lower end of the knob having a diameter equal to an internal diameter of the internal passageway, wherein the knob is pivotally connected to the base on a pivot axis that is perpendicular to said longitudinal axis of the knob:

wherein the knob is pivotal relative to the base on said pivot axis to an acute angle relative to said plane, to place the longitudinal axis of the knob vertical when said portion of the base is set on a non-horizontal portion of the sink surface, so that water filling the roller will overflow around a top edge of said roller to clean the entire roller outer surface.

16. A paint roller cleaning system as in claim 15, wherein said base comprises no protrusions extending downward from said plane.

17. A paint roller cleaning system as in claim 15, wherein said base comprises no threaded legs and no pivotal legs protruding down from said plane.

18. A paint roller cleaning system as in claim 15, wherein the pivot axis is horizontal.

19. A paint roller cleaning system as in claim 15, wherein the knob outer surface is rigid and non-compressible.

20. A paint roller cleaning system as in claim 15, wherein the knob outer surface is compressible.

21. A method of cleaning a paint roller, the method comprising:

providing a paint roller having an internal passageway and a cylindrical roller outer surface, and a paint roller cleaner device, the cleaner device comprising:

a base comprising a bottom surface, at least a portion of which is flat and on a plane;

a knob comprising a longitudinal axis, a generally cylindrical outer surface having a lower diameter at or near a lower end of the outer surface near the base, and an upper diameter at or near an upper end of the outer surface, said upper diameter being smaller than said lower diameter, wherein the knob is pivotally connected to the base on a pivot axis that is perpendicular to said longitudinal axis of the knob; and the method further comprising:

placing the cleaner device in a sink with said portion of the base resting on a non-horizontal portion of the sink so that said plane is non-horizontal;

pushing said paint roller onto said knob after said placing of the cleaner device in the sink, so that the knob is received in an internal passageway of said paint roller and sealed to the internal passageway at a location, between the upper end and the lower end of the knob, having a diameter equal to an internal diameter of the internal passageway; and pushing the paint roller down to press the base against the sink surface and pivoting the paint roller to pivot the knob relative to the base to an acute angle relative to said plane to place the longitudinal axes of the knob and of the paint roller in a vertical orientation; and filling the roller with water from a faucet supplying water to the sink, so that the water overflows around a top edge of said roller to clean the entire roller outer surface.

22. A method as in claim 21, wherein said pushing the paint roller onto the knob, and said pushing the paint roller down to press the base against the sink surface and pivoting the paint roller to pivot the knob, are done by one hand.

* * * * *